US011614761B2

(12) United States Patent
Lee

(10) Patent No.: US 11,614,761 B2
(45) Date of Patent: Mar. 28, 2023

(54) LOW-DROPOUT REGULATOR

(71) Applicant: SK hynix Inc., Gyeonggi-do (KR)

(72) Inventor: Junghan Lee, Gyeonggi-do (KR)

(73) Assignee: SK hynix Inc., Gyeonggi-do (KR)

( * ) Notice: Subject to any disclaimer, the term of this patent is extended or adjusted under 35 U.S.C. 154(b) by 0 days.

(21) Appl. No.: 17/468,353

(22) Filed: Sep. 7, 2021

(65) Prior Publication Data

US 2022/0300020 A1 Sep. 22, 2022

(30) Foreign Application Priority Data

Mar. 19, 2021 (KR) ..... 10-2021-0036141

(51) Int. Cl.
*G05F 1/46* (2006.01)
*G05F 1/575* (2006.01)
*G05F 1/571* (2006.01)

(52) U.S. Cl.
CPC ..... *G05F 1/575* (2013.01); *G05F 1/571* (2013.01)

(58) Field of Classification Search
None
See application file for complete search history.

(56) References Cited

U.S. PATENT DOCUMENTS 6,522,111 B2 * 2/2003 Zadeh ..... G05F 1/575 323/277
7,307,469 B2 * 12/2007 Yamada ..... G05F 1/465 327/540
7,893,672 B2 * 2/2011 Scoones ..... G05F 1/56 323/280
8,044,646 B2 * 10/2011 Ozalevli ..... G05F 1/56 323/275
9,195,244 B2 * 11/2015 Wang ..... G05F 1/10
9,261,892 B2 * 2/2016 Wang ..... G05F 1/56
9,886,049 B2 * 2/2018 Qing ..... G05F 1/575
10,001,795 B2 * 6/2018 Jefremow ..... G05F 1/575
10,571,941 B2 * 2/2020 Sakaguchi ..... H03F 3/45183
10,838,445 B2 * 11/2020 Nagai ..... G05F 1/575
10,860,043 B2 * 12/2020 Hung ..... G05F 1/565
10,915,121 B2 * 2/2021 Magod Ramakrishna ..... G05F 1/565
11,347,249 B2 * 5/2022 Shreepathi Bhat ..... G05F 1/575
2011/0156674 A1 * 6/2011 Lin ..... G05F 1/575 323/282
2013/0119954 A1 * 5/2013 Lo ..... G05F 1/575 323/280
2015/0061757 A1 * 3/2015 Guo ..... G05F 1/575 327/540

(Continued)

FOREIGN PATENT DOCUMENTS

KR 1020140058738 A 5/2014
KR 1020200014388 A 2/2020

*Primary Examiner* — Thomas J. Hiltunen
(74) *Attorney, Agent, or Firm* — IP & T Group LLP

(57) ABSTRACT

A low-dropout regulator includes a comparator for comparing a feedback voltage with a reference voltage to output a comparison signal, which corresponds to a comparison result, to a control node; an internal voltage generator coupled to the control node, and for generating the feedback voltage and an internal voltage based on the comparison signal; and a controller coupled to the control node, and for monitoring the internal voltage based on the comparison signal, and controlling a voltage level of the comparison signal according to a monitoring result.

18 Claims, 7 Drawing Sheets

(56) References Cited

U.S. PATENT DOCUMENTS

| | | | | |
|---|---|---|---|---|
| 2015/0097541 | A1* | 4/2015 | Banag | G05F 1/575 323/281 |
| 2016/0105113 | A1* | 4/2016 | Tsuzaki | G05F 1/573 323/271 |
| 2020/0012302 | A1* | 1/2020 | Fiocchi | G05F 1/575 |
| 2021/0080985 | A1* | 3/2021 | Shreepathi Bhat | G05F 1/565 |
| 2021/0173422 | A1* | 6/2021 | Sorace | G05F 1/445 |

* cited by examiner

LOW-DROPOUT REGULATOR

CROSS-REFERENCE TO RELATED APPLICATION(S)

This application claims priority under 35 U.S.C. § 119 to Korean Patent Application No. 10-2021-0036141, filed on Mar. 19, 2021, the disclosure of which is incorporated herein by reference in its entirety.

BACKGROUND

1. Field

Various embodiments of the present disclosure relate to a semiconductor design technique, and more particularly, to a low-dropout regulator.

2. Description of the Related Art

A semiconductor device can generate and use an internal voltage having a relatively lower level than a supply voltage. For example, such a semiconductor device can include a low-dropout regulator as a circuit for generating the internal voltage. In order for the semiconductor device to operate normally, it is important to accurately monitor the internal voltage.

SUMMARY

Various embodiments of the present disclosure are directed to a low-dropout regulator capable of generating a stable internal voltage through a monitoring operation.

In accordance with one embodiment, a low-dropout regulator may include: a comparator suitable for comparing a feedback voltage with a reference voltage to output a comparison signal, which corresponds to a comparison result, to a control node; an internal voltage generator coupled to the control node, and suitable for generating the feedback voltage and an internal voltage based on the comparison signal; and a controller coupled to the control node, and suitable for monitoring the internal voltage based on the comparison signal, and controlling a voltage level of the comparison signal according to a monitoring result.

The controller may be suitable to monitor a load current flowing through an output node of the internal voltage based on the comparison signal, and suppress undershoot and overshoot of the internal voltage according to the monitoring result.

The controller may be suitable to suppress the undershoot of the internal voltage when the monitoring result satisfies a first condition, and suppress the overshoot of the internal voltage when the monitoring result satisfies a second condition.

The first condition may be a case where the load current is higher than a first threshold level when the load current changes from a target level to a peak level, and the second condition may be a case where the load current is lower than a second threshold level when the load current changes from the peak level to the target level.

The second threshold level may be higher than the first threshold level.

In accordance with one embodiment, a low-dropout regulator may include: a comparator suitable for comparing a feedback voltage with a reference voltage to generate a comparison signal corresponding to a comparison result; an internal voltage generator suitable for generating the feedback voltage and an internal voltage based on the comparison signal; a monitoring circuit suitable for monitoring a load current flowing through an output node of the internal voltage generator, based on the comparison signal, a first suppression signal and a second suppression signal to generate a monitoring signal corresponding to a monitoring result; a suppression signal generating circuit suitable for, based on the monitoring signal, generating the first suppression signal for suppressing undershoot of the internal voltage when the monitoring result satisfies a first condition, and generating the second suppression signal for suppressing overshoot of the internal voltage when the monitoring result satisfies a second condition; and a control circuit suitable for controlling a voltage level of the comparison signal based on the first and second suppression signals.

The first condition may be a case where the load current is higher than a first threshold level when the load current changes from a target level to a peak level, and the second condition may be a case where the load current is lower than a second threshold level when the load current changes from the peak level to the target level.

The second threshold level may be higher than the first threshold level.

In accordance with one embodiment, a low-dropout regulator may include: a voltage generator suitable for generating an output voltage corresponding to an input voltage, and generating a control signal corresponding to a voltage level of the output voltage; and a controller suitable for suppressing undershoot and overshoot of the output voltage based on the control signal.

The controller may be suitable to monitor a load current flowing through an output node of the output voltage based on the control signal, and suppress the undershoot and the overshoot of the output voltage according to a monitoring result.

The controller may be suitable to suppress the undershoot of the output voltage when the monitoring result satisfies a first condition, and suppress the overshoot of the output voltage when the monitoring result satisfies a second condition.

The first condition may be a case where the load current is higher than a first threshold level when the load current changes from a target level to a peak level, and the second condition may be a case where the load current is lower than a second threshold level when the load current changes from the peak level to the target level.

The second threshold level may be higher than the first threshold level.

In one embodiment, the voltage generator may include: a comparator suitable for comparing a reference voltage with a feedback voltage to generate the control signal corresponding to a comparison result; and a generator suitable for generating the feedback voltage and the output voltage based on the control signal.

DETAILED DESCRIPTION

Various embodiments are described below with reference to the accompanying drawings, in order to describe in detail the present disclosure so that those with ordinary skill in art to which the present disclosure pertains may easily carry out the technical spirit of the present disclosure.

It will be understood that when an element is referred to as being "connected to" or "coupled to" another element, the element may be directly connected to or coupled to the another element, or electrically connected to or coupled to the another element with one or more elements interposed therebetween. In addition, it will also be understood that the terms "comprises," "comprising," "includes," and "including" when used in this specification do not preclude the presence of one or more other elements, but may further include or have the one or more other elements, unless otherwise mentioned. In the description throughout the specification, some components are described in singular forms, but the present disclosure is not limited thereto, and it will be understood that the components may be formed in plural.

Figure 1:
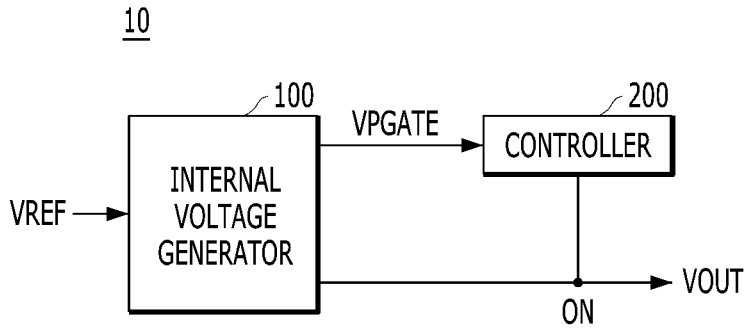
FIG. 1 is a block diagram illustrating a low-dropout regulator in accordance with one embodiment.

FIG. 1 is a block diagram illustrating a low-dropout regulator 10 in accordance with an embodiment.

Referring to FIG. 1, the low-dropout regulator 10 may include an internal voltage generator 100 and a controller 200.

The internal voltage generator 100 may receive a reference voltage VREF as an input voltage, and generate an internal voltage VOUT as an output voltage. The internal voltage generator 100 may generate the internal voltage VOUT corresponding to the reference voltage VREF. The internal voltage generator 100 may generate a control signal corresponding to a voltage level of the internal voltage VOUT. The control signal may refer to a comparison signal VPGATE, which is described below.

Figure 2:
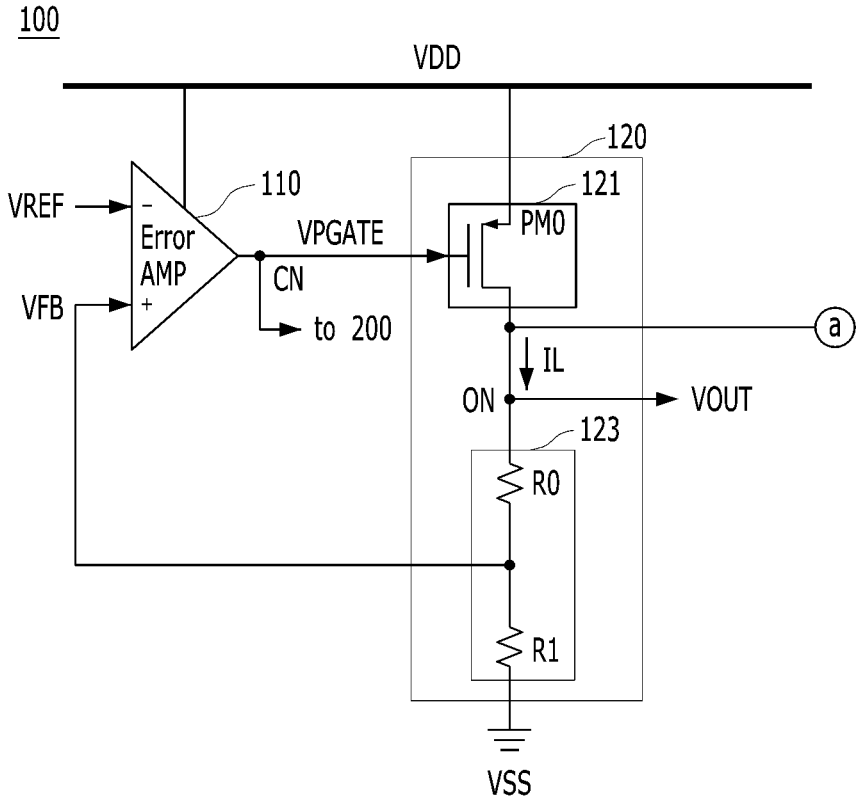
FIG. 2 is a circuit diagram illustrating an internal voltage generator illustrated in FIG. 1.

The controller 200 may be coupled to a control node CN and an output node ON (these nodes are shown in FIG. 2). The control node CN may be a node to which the comparison signal VPGATE generated by the internal voltage generator 100 is outputted, and the output node ON may be a node where the internal voltage VOUT is generated. The controller 200 may control the voltage level of the internal voltage VOUT based on the comparison signal VPGATE. In one embodiment, the controller 200 may monitor a load current IL flowing through the output node ON of the internal voltage VOUT based on the comparison signal VPGATE, and suppress undershoot and overshoot of the internal voltage VOUT according to the monitoring result.

FIG. 2 is a circuit diagram illustrating the internal voltage generator 100 illustrated in FIG. 1.

Referring to FIG. 2, the internal voltage generator 100 may include a comparator 110 and a generator 120.

The comparator 110 may compare the reference voltage VREF with a feedback voltage VFB, and output the comparison signal VPGATE, which corresponds to the comparison result, to the control node CN.

The generator 120 may be coupled to the control node CN. The generator 120 may generate the feedback voltage VFB and the internal voltage VOUT based on the comparison signal VPGATE. In one embodiment, the generator 120 may include a driver 121 and a voltage divider 123.

The driver 121 may drive the output node ON of the internal voltage VOUT with a high voltage VDD based on the comparison signal VPGATE. In one embodiment, the driver 121 may include a first PMOS transistor PM0. The first PMOS transistor PM0 may have a gate terminal receiving the comparison signal VPGATE, and a source terminal and a drain terminal coupled between a supply terminal of the high voltage VDD and the output node ON of the internal voltage VOUT.

In one embodiment, the voltage divider 123 may divide the internal voltage VOUT at a predetermined ratio, and generate the feedback voltage VFB. The voltage divider 123 may include first and second resistors R0 and R1.

The first resistor R0 may be coupled between the output node ON of the internal voltage VOUT and an output node of the feedback voltage VFB.

The second resistor R1 may be coupled between the output node of the feedback voltage VFB and a supply terminal of a low voltage VSS.

Figure 3:
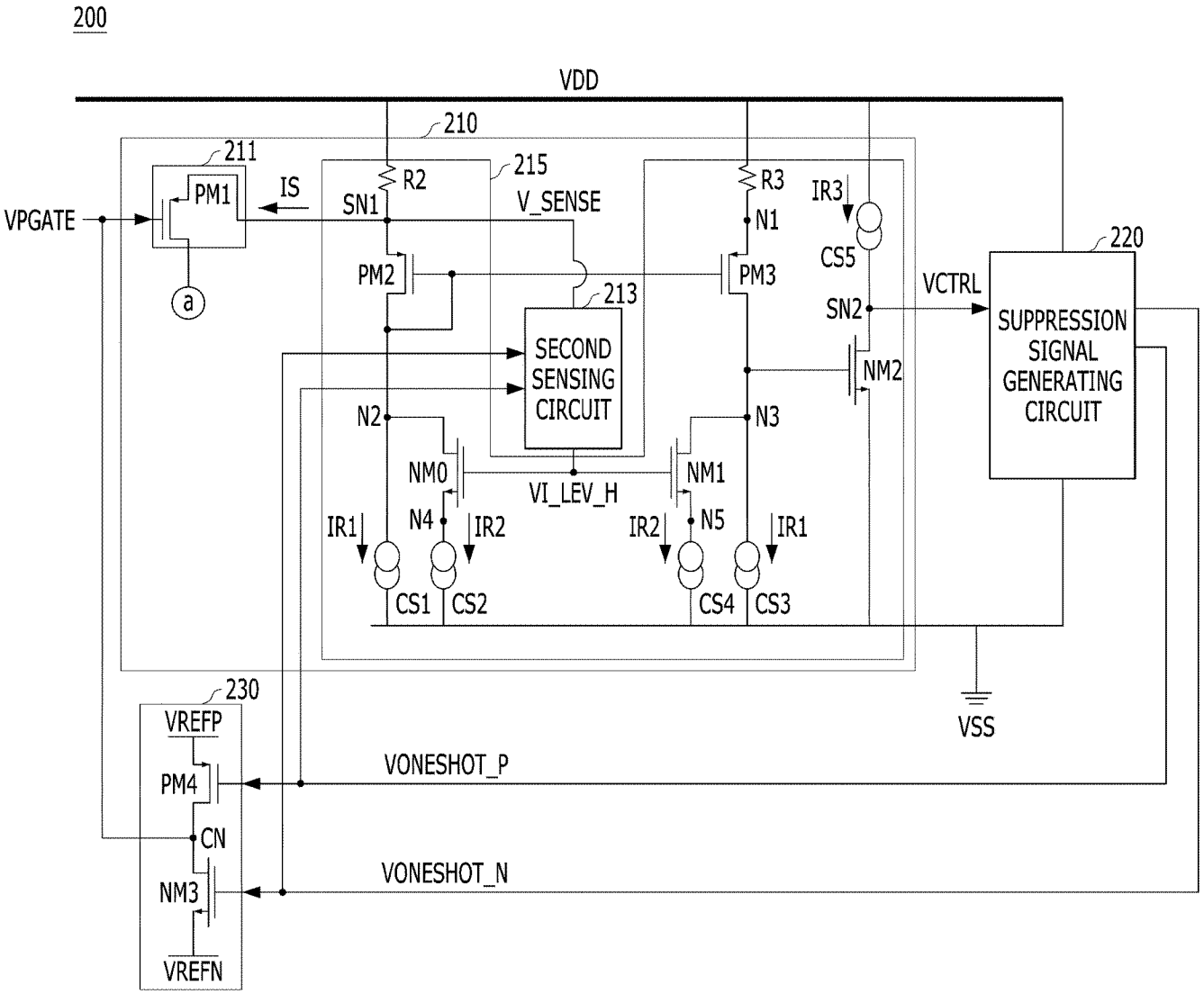
FIG. 3 is a circuit diagram illustrating a controller illustrated in FIG. 1.

FIG. 3 is a circuit diagram illustrating the controller 200 illustrated in FIG. 1.

Referring to FIG. 3, the controller 200 may include a monitoring circuit 210, a suppression signal generating circuit 220 and a control circuit 230.

The monitoring circuit 210 may monitor the load current IL flowing through the output node ON of the internal voltage VOUT based on the comparison signal VPGATE, a first suppression signal VONESHOT_N and a second suppression signal VONESHOT_P, and generate a monitoring signal VCTRL corresponding to the monitoring result. In one embodiment, the monitoring circuit 210 may include a first sensing circuit 211, a second sensing circuit 213 and a third sensing circuit 215.

The first sensing circuit 211 may generate a sensing current IS corresponding to the load current IL based on the comparison signal VPGATE. The first sensing circuit 211 may generate the sensing current IS by mirroring the load current IL. The first sensing circuit 211 may include a second PMOS transistor PM1. The second PMOS transistor PM1 may have a gate terminal receiving the comparison signal VPGATE, and a source terminal and a drain terminal coupled between a first sensing node SN1 and the output node ON of the internal voltage VOUT. When the size of the first PMOS transistor PM0 is "M", the size of the second PMOS transistor PM1 may be "1". In one embodiment, the size of the second PMOS transistor PM1 may correspond to "1/M" of the size of the first PMOS transistor PM0.

The second sensing circuit 213 may sense a level of the load current IL based on a sensing voltage V_SENSE corresponding to the sensing current IS, the first suppression signal VONESHOT_N and the second suppression signal VONESHOT_P, and generate a sensing signal VI_LEV_H corresponding to the sensing result. In one embodiment, the second sensing circuit 213 may activate the sensing signal VI_LEV_H when the level of the load current IL satisfies a first condition, and deactivate the sensing signal VI_LEV_H when the level of the load current satisfies a second condition.

The third sensing circuit 215 may generate the monitoring signal VCTRL based on the sensing current IS and the sensing signal VI_LEV_H. In one embodiment, the third sensing circuit 215 may include a third resistor R2, a fourth resistor R3, a mirroring circuit PM2 and PM3, a first current source CS1, a first switch NM0, a second current source CS2, a third current source CS3, a second switch NM1, a fourth current source CS4, a third switch NM2 and a fifth current source CS5.

The third resistor R2 may be coupled between the supply terminal of the high voltage VDD and the first sensing node SN1.

The fourth resistor R3 may be coupled between the supply terminal of the high voltage VDD and a first node N1. In one embodiment, a resistance value of the fourth resistor R3 may correspond to "M" times a resistance value of the third resistor R2.

The mirroring circuit PM2 and PM3 may be coupled among the first sensing node SN1, the first node N1, a second node N2 and a third node N3. In one embodiment, the mirroring circuit PM2 and PM3 may include a third PMOS transistor PM2 and a fourth PMOS transistor PM3. The third PMOS transistor PM2 may have a gate terminal and a drain terminal coupled thereto, and a source terminal and a drain terminal coupled between the first sensing node SN1 and the second node N2. The fourth PMOS transistor PM3 may have a gate terminal coupled to the gate terminal of the third PMOS transistor PM2, and a source terminal and a drain terminal coupled between the first node N1 and the third node N3.

The first current source CS1 may be coupled between the second node N2 and the supply terminal of the low voltage VSS. The first current source CS1 may generate a first reference current IR1.

The first switch NM0 may be coupled between the second node N2 and a fourth node N4. The first switch NM0 may be controlled by the sensing signal VI_LEV_H. The first switch NM0 may include a first NMOS transistor. The first NMOS transistor may have a gate terminal receiving the sensing signal VI_LEV_H, and a source terminal and a drain terminal coupled between the second node N2 and the fourth node N4.

The second current source CS2 may be coupled between the fourth node N4 and the supply terminal of the low voltage VSS. The second current source CS2 may generate a second reference current IR2.

The third current source CS3 may be coupled between the third node N3 and the supply terminal of the low voltage VSS. The third current source CS3 may generate the first reference current IR1.

The second switch NM1 may be coupled between the third node N3 and a fifth node N5. The second switch NM1 may be controlled by the sensing signal VI_LEV_H. The second switch NM1 may include a second NMOS transistor. The second NMOS transistor may have a gate terminal receiving the sensing signal VI_LEV_H, and a source terminal and a drain terminal coupled between the third node N3 and the fifth node N5.

The fourth current source CS4 may be coupled between the fifth node N5 and the supply terminal of the low voltage VSS. The fourth current source CS4 may generate the second reference current IR2.

The third switch NM2 may be coupled between a second sensing node SN2 to which the monitoring signal VCTRL is outputted and the supply terminal of the low voltage VSS. The third switch NM2 may be controlled by a voltage applied to the third node N3. The third switch NM2 may include a third NMOS transistor. The third NMOS transistor may have a gate terminal coupled to the third node N3, and a source terminal and a drain terminal coupled between the second sensing node SN2 and the supply terminal of the low voltage VSS.

The fifth current source CS5 may be coupled between the supply terminal of the high voltage VDD and the second sensing node SN2. The fifth current source CS5 may generate a third reference current IR3.

The suppression signal generating circuit 220 may generate the first suppression signal VONESHOT_N for suppressing the undershoot of the internal voltage VOUT when the monitoring result satisfies the first condition, and generate the second suppression signal VONESHOT_P for suppressing the overshoot of the internal voltage VOUT when the monitoring result satisfies the second condition, based on the monitoring signal VCTRL. The first condition may be a case where the load current is higher than a first threshold level when the load current changes from a target level to a peak level. The second condition may be a case where the load current is lower than a second threshold level when the load current changes from the peak level to the target level.

The control circuit 230 may control a voltage level of the comparison signal VPGATE based on the first suppression signal VONESHOT_N and the second suppression signal VONESHOT_P. The control circuit 230 may lower the voltage level of the comparison signal VPGATE based on the first suppression signal VONESHOT_N, and raise the voltage level of the comparison signal VPGATE based on the second suppression signal VONESHOT_P. The control circuit 230 may include a first driver NM3 and a second driver PM4.

The first driver NM3 may drive the control node CN, to which the comparison signal VPGATE is outputted, with a pull-down voltage VREFN based on the first suppression signal VONESHOT_N. The first driver NM3 may include a fourth NMOS transistor. The fourth NMOS transistor may have a gate terminal receiving the first suppression signal VONESHOT_N, and a source terminal and a drain terminal coupled between the control node CN and a supply terminal of the pull-down voltage VREFN.

The second driver PM4 may drive the control node CN with a pull-up voltage VREFP based on the second suppression signal VONESHOT_P. The second driver PM4 may include a fifth PMOS transistor. The fifth PMOS transistor may have a gate terminal receiving the second suppression signal VONESHOT_P, and a source terminal and a drain terminal coupled between the control node CN and a supply terminal of the pull-up voltage VREFP.

Figure 4:
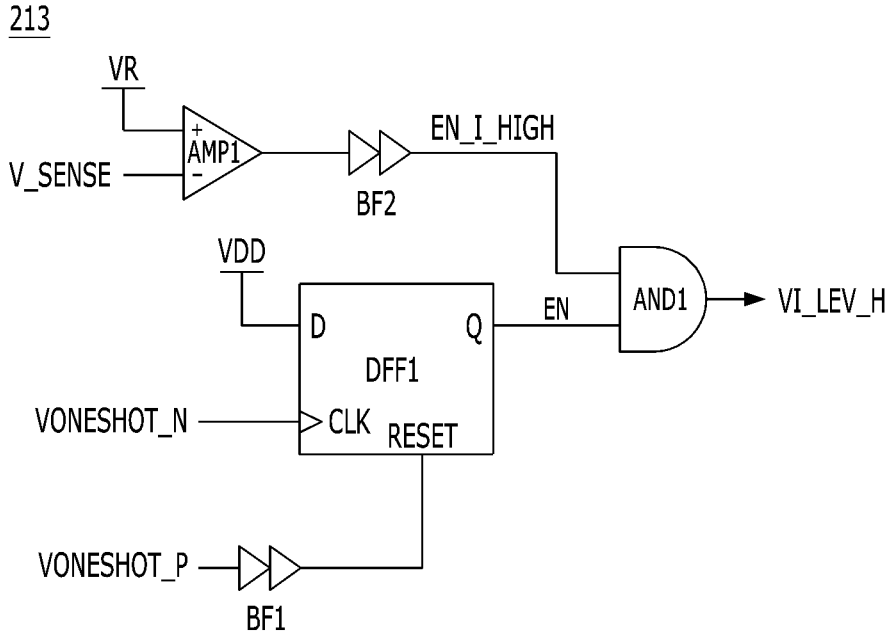
FIG. 4 is a circuit diagram illustrating a second sensing circuit illustrated in FIG. 3.

FIG. 4 is a circuit diagram illustrating the second sensing circuit 213 illustrated in FIG. 3.

Referring to FIG. 4, the second sensing circuit 213 may include a first circuit DFF1, a second circuit AMP1 and a third circuit AND1.

The first circuit DFF1 may generate a first condition check signal EN based on the first suppression signal VONESHOT_N and the second suppression signal VONESHOT_P. The first circuit DFF1 may include a D flip-flop. The D flip-flop may receive the high voltage VDD through an input terminal D thereof, receive the first suppression signal VONESHOT_N through a clock terminal CLK thereof, receive the second suppression signal VONESHOT_P through a reset terminal RESET thereof, and output the first condition check signal EN through an output terminal Q thereof.

The second circuit AMP1 may compare the sensing voltage V_SENSE with a predetermined voltage VR, and generate a second condition check signal EN_I_HIGH corresponding to the comparison result. The predetermined voltage VR may be a reference voltage having a constant voltage level.

The third circuit AND1 may generate the sensing signal VI_LEV_H based on the first condition check signal EN and the second condition check signal EN_I_HIGH. The third circuit AND1 may continuously deactivate the sensing signal VI_LEV_H according to the second condition check signal EN_I_HIGH regardless of the first condition check signal EN. The third circuit AND1 may include an AND gate.

The second sensing circuit 213 may further include at least one of a first buffer BF1 and a second buffer BF2 depending on design. Each of the first and second buffers BF1 and BF2 may be related to a delay time.

Figure 5:
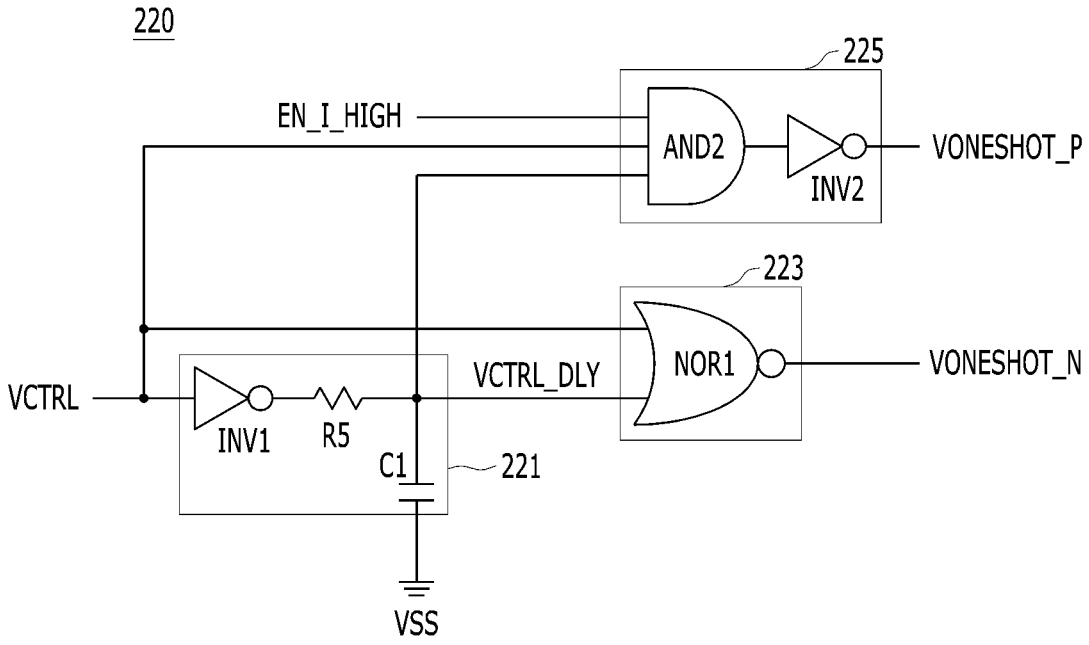
FIG. 5 is a circuit diagram illustrating a suppression signal generating circuit illustrated in FIG. 3.

FIG. 5 is a circuit diagram illustrating the suppression signal generating circuit 220 illustrated in FIG. 3.

Referring to FIG. 5, the suppression signal generating circuit 220 may include a delay circuit 221, a first logic circuit 223 and a second logic circuit 225.

The delay circuit 221 may delay the monitoring signal VCTRL by a predetermined delay time, and generate a delayed monitoring signal VCTRL_DLY. The delay circuit 221 may include a first inverter INV1, a fifth resistor R5 and a first capacitor C1.

The first logic circuit 223 may generate the first suppression signal VONESHOT_N based on the monitoring signal VCTRL and the delayed monitoring signal VCTRL_DLY. The first logic circuit 223 may include a first NOR gate NOR1.

The second logic circuit 225 may generate the second suppression signal VONESHOT_P based on the monitoring signal VCTRL, the delayed monitoring signal VCTRL_DLY and the second condition check signal EN_I_HIGH. The second logic circuit 225 may continuously deactivate the second suppression signal VONESHOT_P according to the second condition check signal EN_I_HIGH regardless of the monitoring signal VCTRL and the delayed monitoring signal VCTRL_DLY. The second logic circuit 225 may include a second AND gate AND2 and a second inverter INV2.

Hereinafter, an operation of the low-dropout regulator 10 in accordance with one embodiment, which has the above-described configuration, is described with reference to FIGS. 6 and 7.

Figure 6:
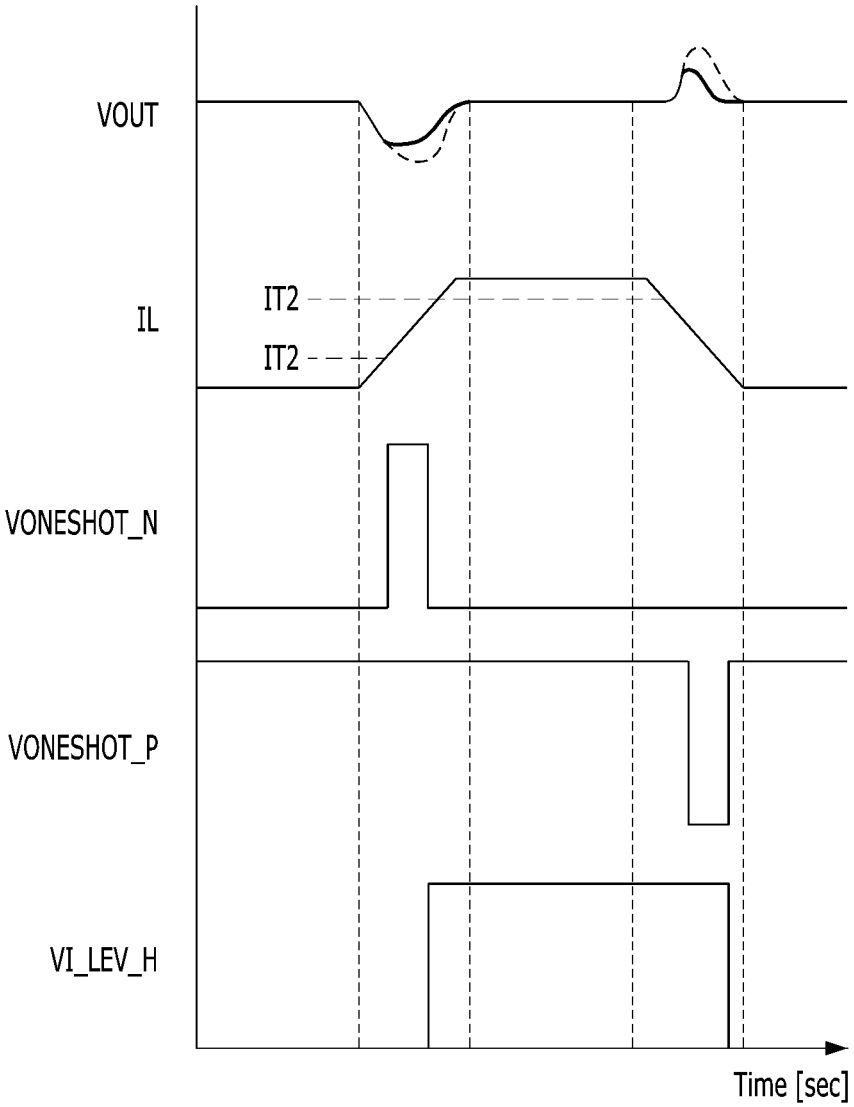
FIGS. 6 and 7 are timing diagrams illustrating an operation of the low-dropout regulator illustrated in FIG. 1.

FIG. 6 is a timing diagram illustrating the operation of the low-dropout regulator 10.

Referring to FIG. 6, the internal voltage generator 100 (illustrated in FIG. 1) may generate the internal voltage VOUT, which corresponds to the reference voltage VREF, through the output node ON (also illustrated in FIG. 1). The controller 200 (also illustrated in FIG. 1) may monitor the load current IL flowing through the output node ON in real time, and suppress the undershoot and the overshoot occurring in the internal voltage VOUT. An operation of the controller 200 is described in more detail as follows.

First, the operation of the controller 200 according to the undershoot is described.

When the first sensing circuit 211 generates the sensing current IS, which corresponds to the load current IL, based on the comparison signal VPGATE, the third sensing circuit 215 may monitor the sensing current IS based on the sensing current IS and the sensing signal VI_LEV_H, and generate the monitoring signal VCTRL corresponding to the monitoring result. The third sensing circuit 215 may generate the monitoring signal VCTRL having a logic low level when the monitoring result satisfies a first condition. The first condition may be a case in which the load current IL is higher than a first threshold level IT1 when the load current IL changes from a target level to a peak level. The first threshold level IT1, the load current IL and the sensing current IS are as shown in Equations 1 to 5 below.

$$IT1=IS=IL/M \quad \text{[Equation 1]}$$

$$IS=R2V=IR1*(M*R3V) \quad \text{[Equation 2]}$$

$$IS=M*IR1 \quad \text{[Equation 3]}$$

$$IT1=M*IR1 \quad \text{[Equation 4]}$$

$$IL=M^2*IR1 \quad \text{[Equation 5]}$$

Herein, "R2V" refers to the resistance value of the third resistor R2, "R3V" refers to the resistance value of the fourth resistor R3, and "M" refers to a ratio between the size of the first PMOS transistor PM0 and the size of the second PMOS transistor PM1 described above.

The suppression signal generating circuit 220 may activate the first suppression signal VONESHOT_N for suppressing the undershoot occurring in the internal voltage VOUT, based on the monitoring signal VCTRL having the logic low level.

The control circuit 230 may lower the voltage level of the comparison signal VPGATE based on the activated first suppression signal VONESHOT_N.

Accordingly, the undershoot of the internal voltage VOUT may be suppressed to a minimized value of undershoot as shown in the leftmost excursion of the internal voltage VOUT at the top of FIG. 6 where the solid line representing the internal voltage VOUT is suppressed relative to the dashed line if no suppression occurred.

Next, the operation of the controller 200 according to the overshoot is described.

When the first sensing circuit 211 generates the sensing current IS, which corresponds to the load current IL, based on the comparison signal VPGATE, the third sensing circuit 215 may monitor the sensing current IS based on the sensing current IS and the sensing signal VI_LEV_H, and generate the monitoring signal VCTRL corresponding to the monitoring result. The third sensing circuit 215 may generate the monitoring signal VCTRL having a logic high level when the monitoring result satisfies the second condition. The second condition may be a case in which the load current IL is lower than a second threshold level IT2 when the load current IL changes from the peak level to the target level. The second threshold level IT2, the load current IL and the sensing current IS are as shown in Equations 6 to 10 below.

$$IT2=IS=IL/M \quad \text{[Equation 6]}$$

$$IS*R2V=(IR1\pm IR2)*(M*R3V) \quad \text{[Equation 7]}$$

$$IS=M*(IR1+IR2) \quad \text{[Equation 8]}$$

$$IT1=M*(IR1+IR2) \quad \text{[Equation 9]}$$

$$IL=M^2*(IR1+IR2) \quad \text{[Equation 10]}$$

The suppression signal generating circuit 220 may activate the second suppression signal VONESHOT_P for suppressing the overshoot occurring in the internal voltage VOUT, based on the monitoring signal VCTRL having the logic high level.

The control circuit 230 may raise the voltage level of the comparison signal VPGATE based on the activated second suppression signal VONESHOT_P.

Accordingly, the overshoot of the internal voltage VOUT may be suppressed for example to a minimized value of overshoot as shown in the rightmost excursion of the internal voltage VOUT signal at the top of FIG. 6 where the solid line representing the internal voltage VOUT is suppressed relative to the dashed line if no suppression occurred.

Figure 7:
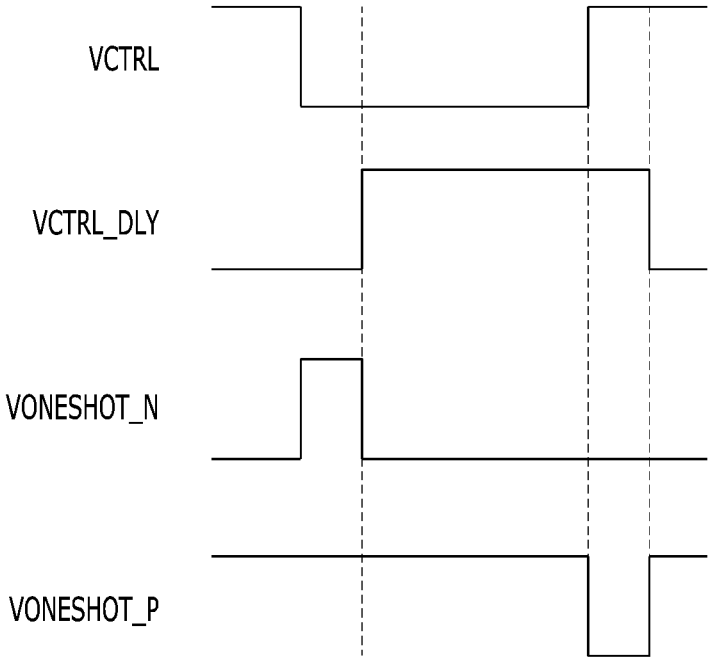

FIG. 7 is a timing diagram illustrating the first suppression signal VONESHOT_N and the second suppression signal VONESHOT_P illustrated in FIG. 6.

Referring to FIG. 7, the first suppression signal VONESHOT_N may be generated based on the monitoring signal VCTRL and the delayed monitoring signal VCTRL_DLY. When the monitoring signal VCTRL has a logic low level and the delayed monitoring signal VCTRL_DLY has a logic low level, the first suppression signal VONESHOT_N may be activated to a logic high level.

The second suppression signal VONESHOT_P may be generated based on the monitoring signal VCTRL, the delayed monitoring signal VCTRL_DLY and the second condition check signal EN_I_HIGH (not illustrated). When the monitoring signal VCTRL has a logic high level, the delayed monitoring signal VCTRL_DLY has a logic high level, and the second condition check signal EN_I_HIGH has a logic high level, the second suppression signal VONESHOT_P may be activated to a logic low level. For reference, when the load current IL does not exceed the second threshold level IT2 (that is, does not satisfy the second condition), the second condition check signal EN_I_HIGH may maintain a logic low level. Accordingly, the second suppression signal VONESHOT_P may maintain a logic high level (that is, a deactivation state) regardless of the monitoring signal VCTRL and the delayed monitoring signal VCTRL_DLY.

According to one embodiment, a stable internal voltage may be generated as the undershoot is suppressed according to the first condition and the overshoot is suppressed according to the second condition.

According to one embodiment, operational reliability of a low-dropout regulator may be improved as an internal voltage generated stably is used.

While the present disclosure has been illustrated and described with respect to specific embodiment, the disclosed embodiment is provided for the description, and not intended to be restrictive. Further, it is noted that the present disclosure may be achieved in various ways through substitution, change, and modification that fall within the scope of the following claims, as those skilled in the art will recognize in light of the present disclosure.

What is claimed is:

1. A low-dropout regulator comprising:

a comparator suitable for comparing a feedback voltage with a reference voltage to output a comparison signal, which corresponds to a comparison result, to a control node;

a generator coupled to the control node, and suitable for generating the feedback voltage and an internal voltage based on the comparison signal; and a controller coupled to the control node, and suitable for generating a sensing current corresponding to a load current flowing through an output node of the internal voltage based on the comparison signal and monitoring the internal voltage based on the sensing current, and controlling a voltage level of the comparison signal according to a monitoring result, wherein the controller comprises:

a first sensing circuit suitable for generating the sensing current corresponding to the load current, based on the comparison signal;

a second sensing circuit suitable for sensing a level of the load current based on a first suppression signal, a second suppression signal, and a sensing voltage corresponding to the sensing current to generate a sensing signal corresponding to a sensing result; and a third sensing circuit suitable for generating a monitoring signal corresponding the monitoring result based on the sensing signal and the sensing current.

2. The low-dropout regulator of claim 1, wherein the controller is suitable to suppress an undershoot of the internal voltage when the monitoring result satisfies a first condition, and suppress an overshoot of the internal voltage when the monitoring result satisfies a second condition.

3. The low-dropout regulator of claim 2, wherein the first condition is a case where the load current is higher than a first threshold level when the load current changes from a target level to a peak level, and the second condition is a case where the load current is lower than a second threshold level when the load current changes from the peak level to the target level.

4. The low-dropout regulator of claim 3, wherein the second threshold level is higher than the first threshold level.

5. A low-dropout regulator comprising:

a comparator suitable for comparing a feedback voltage with a reference voltage to generate a comparison signal corresponding to a comparison result;

a generator suitable for generating the feedback voltage and an internal voltage based on the comparison signal;

a monitoring circuit suitable for generating a sensing current corresponding to a load current flowing through an output node of the internal voltage based on the comparison signal, a first suppression signal and a second suppression signal and monitoring the internal voltage based on the sensing current to generate a monitoring signal corresponding to a monitoring result;

a suppression signal generating circuit suitable for, based on the monitoring signal, generating the first suppression signal for suppressing undershoot of the internal voltage when the monitoring result satisfies a first condition, and generating the second suppression signal for suppressing overshoot of the internal voltage when the monitoring result satisfies a second condition; and a control circuit suitable for controlling a voltage level of the comparison signal based on the first and second suppression signals.

6. The low-dropout regulator of claim 5, wherein the first condition is a case where the load current is higher than a first threshold level when the load current changes from a target level to a peak level, and the second condition is a case where the load current is lower than a second threshold level when the load current changes from the peak level to the target level.

7. The low-dropout regulator of claim 6, wherein the second threshold level is higher than the first threshold level.

8. The low-dropout regulator of claim 5, wherein the monitoring circuit comprises:

a first sensing circuit suitable for generating the sensing current corresponding to the load current, based on the comparison signal;

a second sensing circuit suitable for sensing a level of the load current based on the first suppression signal, the second suppression signal, and a sensing voltage corresponding to the sensing current to generate a sensing signal corresponding to a sensing result; and a third sensing circuit suitable for generating the monitoring signal based on the sensing signal and the sensing current.

9. The low-dropout regulator of claim 8, wherein the first sensing circuit is suitable to mirror the load current to generate the sensing current.

10. The low-dropout regulator of claim 8, wherein the second sensing circuit comprises:

a first circuit suitable for generating a first condition check signal based on the first and second suppression signals;

a second circuit suitable for comparing the sensing voltage with a predetermined voltage having a fixed voltage level to generate a second condition check signal corresponding to the comparison result; and a third circuit suitable for generating the sensing signal based on the first and second condition check signals.

11. The low-dropout regulator of claim 8, wherein the third sensing circuit comprises:

a first resistor coupled between a supply terminal of a high voltage and a first sensing node to which the sensing voltage is applied;

a second resistor coupled between the supply terminal of the high voltage and a first node;

a mirroring circuit coupled among the first sensing node, the first node, a second node and a third node;

a first current source coupled between the second node and a supply terminal of a low voltage, and suitable for generating a first reference current;

a first switch coupled between the second node and a fourth node, and controlled by the sensing signal;

a second current source coupled between the fourth node and the supply terminal of the low voltage, and suitable for generating a second reference current;

a third current source coupled between the third node and the supply terminal of the low voltage, and suitable for generating the first reference current;

a second switch coupled between the third node and a fifth node, and controlled by the sensing signal;

a fourth current source coupled between the fifth node and the supply terminal of the low voltage, and suitable for generating the second reference current;

a third switch coupled between a second sensing node to which the monitoring signal is outputted and the supply terminal of the low voltage, and controlled by a voltage applied to the third node; and a fifth current source coupled between the supply terminal of the high voltage and the second sensing node, and suitable for generating a third reference current.

12. The low-dropout regulator of claim 10, wherein the suppression signal generating circuit comprises:

a delay circuit suitable for delaying the monitoring signal by a predetermined delay time to generate a delayed monitoring signal;

a first logic circuit suitable for generating the first suppression signal based on the monitoring signal and the delayed monitoring signal; and a second logic circuit suitable for generating the second suppression signal based on the monitoring signal, the delayed monitoring signal and the second condition check signal.

13. The low-dropout regulator of claim 5, wherein the control circuit comprises:

a first driver suitable for driving a control node with a pull-down voltage based on the first suppression signal, wherein the comparison signal is outputted through the control node; and a second driver suitable for driving the control node with a pull-up voltage based on the second suppression signal.

14. A low-dropout regulator comprising:

a voltage generator suitable for generating an output voltage corresponding to an input voltage, and generating a control signal corresponding to a voltage level of the output voltage; and a controller suitable for generating a sensing current corresponding to a load current flowing through an output node of the output voltage based on the control signal and suppressing undershoot and overshoot of the output voltage based on the sensing current, wherein the controller comprises:

a first sensing circuit suitable for generating the sensing current corresponding to the load current, based on the control signal;

a second sensing circuit suitable for sensing a level of the load current based on a first suppression signal, a second suppression signal, and a sensing voltage corresponding to the sensing current to generate a sensing signal corresponding to a sensing result; and a third sensing circuit suitable for generating a monitoring signal based on the sensing signal and the sensing current.

15. The low-dropout regulator of claim 14, wherein the controller is suitable to suppress the undershoot of the output voltage when the monitoring result satisfies a first condition, and suppress the overshoot of the output voltage when the monitoring result satisfies a second condition.

16. The low-dropout regulator of claim 15, wherein the first condition is a case where the load current is higher than a first threshold level when the load current changes from a target level to a peak level, and the second condition is a case where the load current is lower than a second threshold level when the load current changes from the peak level to the target level.

17. The low-dropout regulator of claim 16, wherein the second threshold level is higher than the first threshold level.

18. The low-dropout regulator of claim 14, wherein the voltage generator comprises:

a comparator suitable for comparing a reference voltage with a feedback voltage to generate the control signal corresponding to a comparison result; and a generator suitable for generating the feedback voltage and the output voltage based on the control signal.

* * * * *